United States Patent [19]

Baker et al.

[11] Patent Number: 4,585,410

[45] Date of Patent: Apr. 29, 1986

[54] TORCH TIP SAVER

[75] Inventors: David S. Baker, 12 Drysdale St., Staten Island, N.Y. 10314; Richard L. Miller, Dix Hills, N.Y.

[73] Assignee: David S. Baker, Staten Island, N.Y.

[21] Appl. No.: 571,333

[22] Filed: Jan. 16, 1984

[51] Int. Cl.[4] ..... F23D 14/46

[52] U.S. Cl. ..... 431/350; 239/288.5

[58] Field of Search ..... 239/288, 288.3, 288.5; 431/350

[56] References Cited

U.S. PATENT DOCUMENTS

| | | | |
|---|---|---|---|
| 2,396,546 | 3/1946 | Windsor | 239/288.5 |
| 2,764,230 | 9/1956 | Richter | 239/288.5 |
| 3,364,704 | 1/1968 | Bernstein | 431/350 |
| 4,025,045 | 5/1977 | Kubiak | 239/288.5 |
| 4,113,289 | 9/1978 | Wagner | 285/420 |

*Primary Examiner*—Carroll B. Dority, Jr.

*Attorney, Agent, or Firm*—Richard L. Miller

[57] ABSTRACT

An accessory for oxygen-acetylene cutting torches which extends their life by heat sinking the torch tip and nozzle while allowing the welder to maintain visual sight of the flame and cutting site at all times. A shield is formed which prevents cutting debris from falling on and blocking the nozzle orifices. The torch tip saver can be secured to a variety of different nozzles having varying outer diameter by means of an expansion fitting and an adjustable clamp. One form of the torch saver has a solid leading edge to prevent deformation of the torch saver if the torch saver is rapped against a hard surface.

2 Claims, 5 Drawing Figures

TORCH TIP SAVER

BACKGROUND OF THE INVENTION

The present invention relates generally to the extension of the life of oxygen acetylene cutting torch tips. In normal use, the nozzles and nozzle tips of torches experience failure and fatigue due to a number of causes. One cause is thermal fatigue. Torch tips, with their relatively small thermal mass, reach exceptionally high temperatures. This causes rapid oxidation of the nozzle and nozzle tip. Cutting often necessitates aiming the nozzle tip at a highly elevated angle with the work surface almost directly overhead. Consequently, debris will often fall onto the nozzle tip interfering with the flow of welding gasses and/or oxygen. It is also often difficult to guide a nozzle tip so that it maintains a uniform distance from the work surface to assure an even cut.

SUMMARY OF THE INVENTION

It is therefore a primary object of the present invention to provide a torch tip saver which will act as a heat sink to lower the temperature of the nozzle and nozzle tip by providing a relatively large thermal mass and a relatively large surface area in order to radiate as much of this stored heat as possible. It is also an object of the present invention to allow the welder visual contact with the cutting flame. This is accomplished by providing flame head bifurcations or by extending and widening the expansion fitting notches provided.

Another object is to provide flame head guides to guide the nozzle tip so that the flame is equidistant from the work surface at all times.

A further object is to allow the attachment of the torch tip saver to nozzles with varying outer diameters. This is accomplished by providing an expansion fitting and an adjustable clamp to temporarily secure the torch tip saver to the nozzle.

A yet further object is to provide an associated fabrication tool to allow swaging of bifurcated and notched tubing in order to flare the tubing into an appropriate shape.

For situations in which the torch tip saver is likely to be impacted and thereby deformed an alternative embodiment is provided in which the outer circumference of the leading edge of the torch tip saver is a solid circle. To this circle flame head guide notches may be added.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
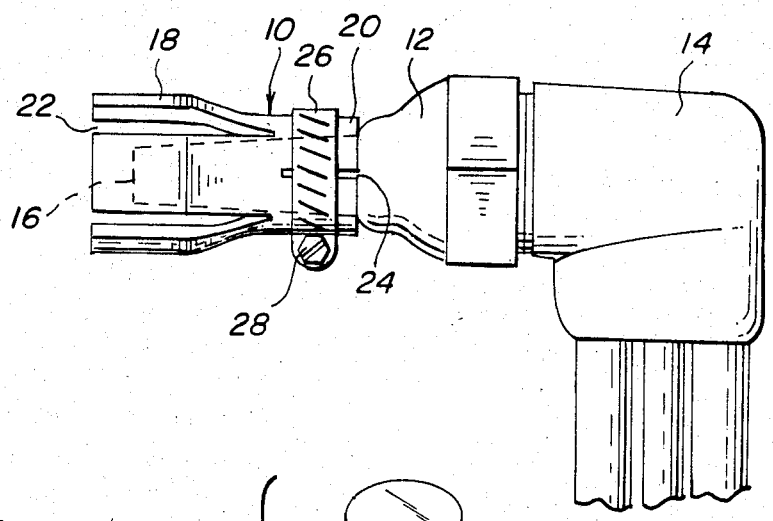
FIG. 1 is a partial side view of an oxygen-acetylene torch with the invention installed on the tip thereof.

Reference is now made in greater detail to the drawing.

In FIG. 1 the invention 10 is shown installed upon the nozzle 12 of an oxygen-acetylene cutting torch 14. Nozzle tip 16 may be seen in dashed relief. The invention itself may be considered to consist of two principal parts: a flame head 18 and an expansion fitting 20. The flame head 18 is provided with sufficient bifurcations 22 to allow for ease of viewing the flame. The expansion fitting 20 has at least one notch 24 to allow for expansion and thereby to allow for some variation in the outside diameter of nozzle 12. A gear clamp 26, adjusted by means of clamp screw 28 temporarily secures the invention 10 to nozzle 12.

Figure 2:
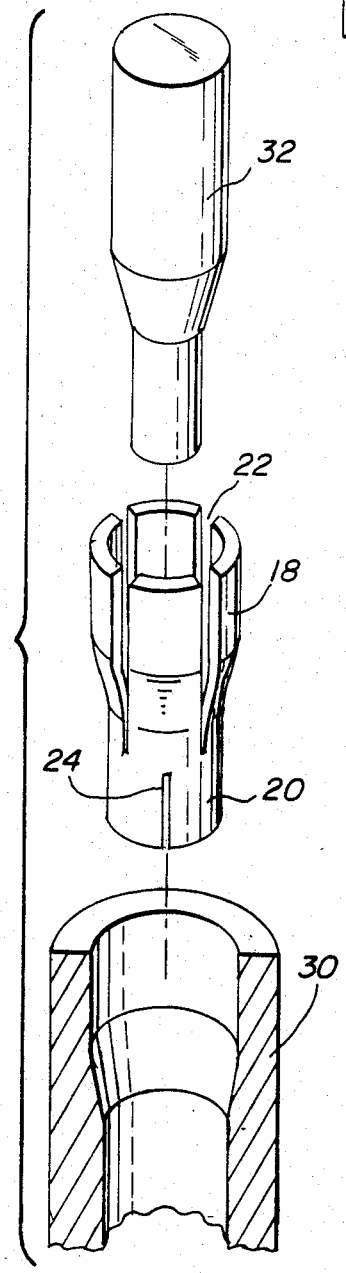
FIG. 2 is an exploded perspective view with parts broken away showing how a die is used to fabricate the invention.

FIG. 2 shows how the invention may be fabricated by using a die casing 30 and a swaging tool 32. A piece of tubing is notched and bifurcated as required and then placed into die casing 30. Swaging tool 32 is inserted into the top of flame head 18 and the top of swaging tool is either impacted or pressed in such a manner as to cause the flaring of flame head 18.

Figure 3:
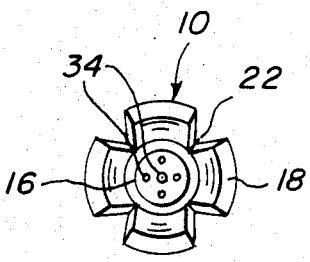
FIG. 3 is a view looking head on at the torch orifices in FIG. 1.

FIG. 3 shows a head on view of the invention 10 when it is mounted upon nozzle 12. In this view typical nozzle jets 34 can be seen.

Figure 4:
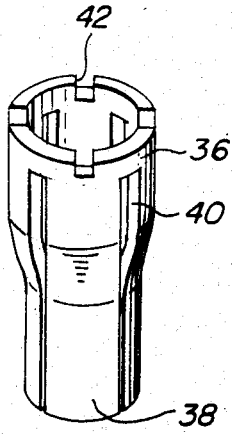
FIG. 4 is a perspective view of an alternative embodiment of the invention in which the leading edge forms a complete circle for added protection. Optional flame head guide notches are shown.
Figure 5:
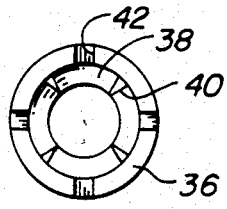
FIG. 5 is a view looking head on of the alternative embodiment in FIG. 4.

FIGS. 4 and 5 shows an alternative embodiment in which extra safety is afforded to the leading edge of flame head 36 by fabricating the invention so that the leading edge forms a complete circle thereby preventing the spreading of unprotected bifurcations. The expansion fitting 38 is provided with elongated expansion fitting notches 40 and these notches 40 widen as they approach the flame head 36 in order to allow the flame to remain visible. Optional flame head guide 42 may be added so that the flame head 36 may be drawn smoothly along an angular edge.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A torch tip saver for the nozzle of a torch, comprising a large cylindrical portion for protecting a torch tip and a smaller cylindrical portion for attaching to the torch tip, said larger and smaller cylindrical portions being connected by a frusto-conical portion, a plurality of circumferentially spaced notches in said large cylindrical portion said frusto-conical portion and said smaller cylindrical portion, each notch extending completely through the smaller cylindrical portion, the frusto-conical portion and through the large cylindrical portion to a location spaced inwardly from an end of the large cylindrical portion, each notch being relatively narrow in width in the smaller cylindrical portion and expanding in width through the frusto-conical portion to a relatively wide width in the large cylindrical portion.

2. A torch tip saver, as recited in claim 1, further comprising a clamp with adjustable clamp screw to secure the temporary attachment of said sleeve member to said nozzle.

* * * * *